United States Patent [19]

Rangabe

[11] 4,001,519

[45] Jan. 4, 1977

[54] PICK-UP CARTRIDGES FOR GRAMOPHONE RECORDS

[76] Inventor: Alexander R. Rangabe, 'Stoneacre', Denmead, Portsmouth, Hampshire, England

[22] Filed: Nov. 22, 1974

[21] Appl. No.: 526,237

[30] Foreign Application Priority Data

Nov. 23, 1973 United Kingdom ..... 54415/73

[52] U.S. Cl. ..... 179/100.41 G; 179/100.41 R

[51] Int. Cl.[2] ..... H04R 19/06; H04R 9/12

[58] Field of Search ..... 179/100.41 R, 100.41 G, 179/100.41 J

[56] References Cited

UNITED STATES PATENTS

| | | | |
|---|---|---|---|
| 2,507,188 | 5/1950 | Weathers | 179/100.41 G |
| 2,542,017 | 2/1951 | Esty | 179/100.41 R |
| 3,872,240 | 3/1975 | Carlson | 179/100.41 G |

*Primary Examiner*—Jay P. Lucas

*Attorney, Agent, or Firm*—Leydig, Voit, Osann, Mayer & Holt, Ltd.

[57] ABSTRACT

A pick-up cartridge for a gramophone record comprises a cartridge shell in which is mounted a stylus assembly including a short, rigid stylus arm and a resilient wire which is much shorter in length than the arm and is attached to the rear end of the arm in alignment with a rear straight part of the arm. Transducer means responsive to movement of the arm are located ahead of the resilient wire and the wire is attached at its rear end to a mounting member supported in the cartridge shell so that the stylus assembly extends forwardly and downwardly away from the cartridge shell. A stylus tip attached to the stylus arm adjacent the forward end thereof is located in the vicinity of the axis of the straight part of the arm.

13 Claims, 12 Drawing Figures

PICK-UP CARTRIDGES FOR GRAMOPHONE RECORDS

FIELD OF THE INVENTION

The present invention relates to pick-up devices for gramophone records.

SUMMARY OF THE INVENTION

According to the present invention, there is provided a pick-up cartridge comprising, a body shell, a low mass stylus assembly having a short rigid stylus arm, a stylus tip mounted adjacent a forward end of the stylus arm a substantial part of the length of the stylus arm extending from the rear end thereof being straight and the stylus tip being located in the vicinity of the axis of the straight part of the arm and a resilient wire substantially shorter in length than the stylus arm fixedly attached at its forward end to the stylus arm so as freely to support the stylus arm and having at least a major portion thereof in alignment with the stylus arm, a mounting member provided on the body shell and supporting the rear end of the resilient wire with the stylus assembly inclined forwardly away from the body shell, and transducer means responsive to movement of the stylus arm mounted in the body shell at a location so as to be wholly between the stylus tip and the resilient wire.

Preferably, a forward end part of the stylus arm on which the stylus tip is located is angled with respect to the straight part of the arm to an extent as to position the stylus tip substantially on the axis of the straight part of the stylus arm.

Further, according to the invention there is provided a stylus assembly for a gramophone record pick-up cartridge, comprising a short low mass rigid stylus arm, a stylus tip mounted adjacent a forward end of the stylus arm, a substantial part of the length of the stylus arm extending from the rear end thereof being straight and the stylus tip being located in the vicinity of the axis of the straight part of the arm, a resilient wire substantially shorter in length than the stylus arm and fixedly attached at its forward end to the stylus arm so as freely to support the stylus arm and having at least a major portion thereof in alignment with the stylus arm, and a mounting member for attachment to a pick-up cartridge which supports the rear end of the resilient wire with the stylus arm when in operative position inclined forwardly and downwardly.

BRIEF DESCRIPTION OF THE DRAWINGS

An embodiment of the present invention will be apparent from the following description by way of example only with reference to the accompanying diagrammatic drawings, in which.

DESCRIPTION OF THE PREFERRED EMBODIMENT

Figure 1:
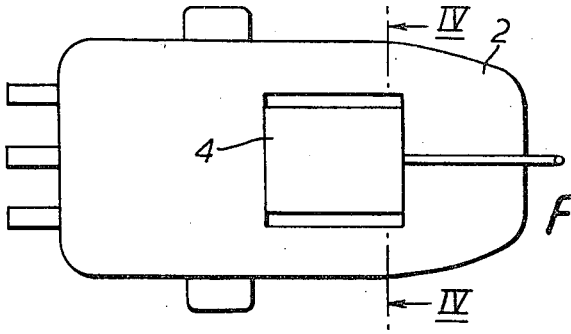
FIG. 1 is an underneath plan view of a pick-up cartridge for a gramophone record.
Figure 2:
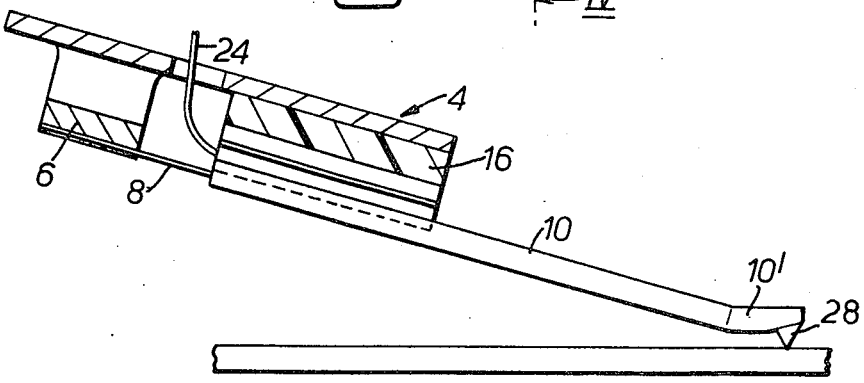
FIG. 2 is a side elevation, to an enlarged scale and partially in section, of a stylus assembly of the cartridge.
Figure 3:
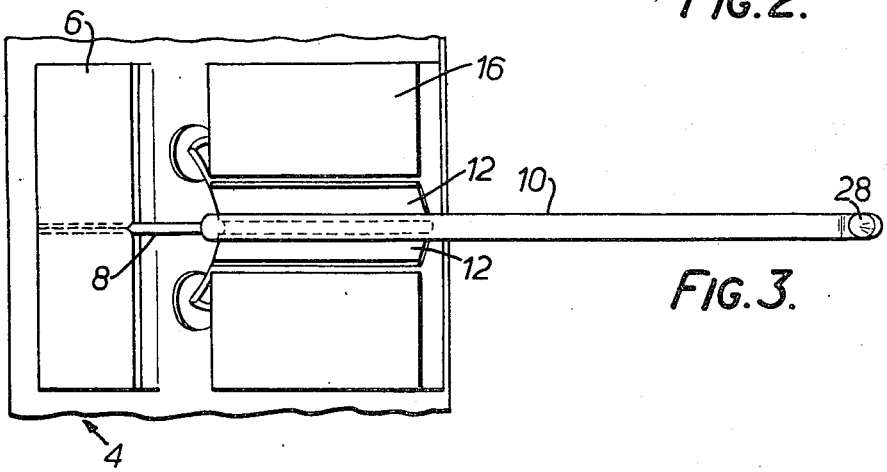
FIG. 3 is an underneath plan view of the stylus assembly.
Figure 4:
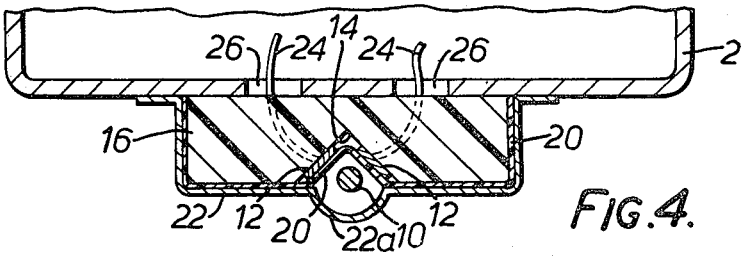
FIG. 4 is a section, to an enlarged scale taken on line IV—IV of FIG. 1.
Figure 5:
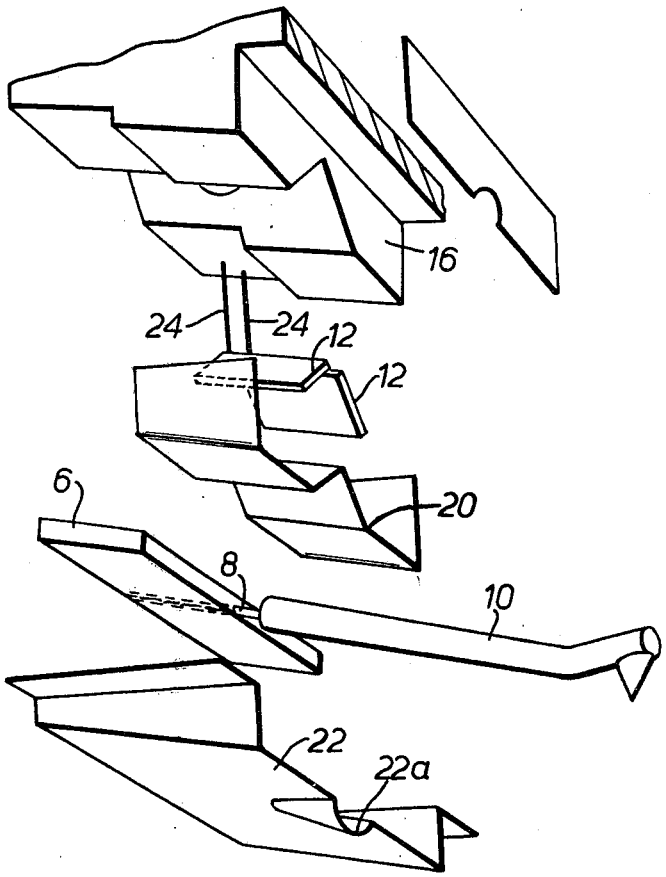
FIG. 5 is a schematic exploded view of the stylus assembly.

As shown in FIGS. 1 to 5, a pick-up cartridge for a stereophonic gramophone record comprises a body 2 carrying a stylus assembly 4. The assembly 4 comprises a transverse strip 6, for example of nickel, to which is anchored, a forwardly extending spring wire 8. The wire 8 is connected at its forward end portion to a stylus arm 10 and acts as the compliance for the arm 10, the wire 8 lying in alignment with the axis of the arm 10.

The rear end portion of the arm 10 acts as the movable electrode of an electrostatic transducer, the transducer further comprising a pair of stationary capacitor plates 12 each inclined at 45° to a vertical plane passing through the axis of the assembly 4. It will thus be apparent that the stylus arm 10 transduces ahead of its compliance in contrast to previously proposed cartridges in which the transducer is located behind the compliance.

The capacitor plates 12 are attached to respective faces of a V-sectioned groove 14 formed in an insulating block 16 secured to the underside of the body 2. The arm 10 lies in the angle between the plates 12 and forms with each plate 12 a respective variable capacitor, the capacitance of which varies according to movement of the arm 10 while the stylus is tracking the record groove. A film 20 of non-conductive material is interposed between the plates 12 and the arm 10 and covers the undersurface and the sides of the block 16. The film 20 prevents electrical noise due to dust or other particles lying between the arm 10 and the capacitor plates 12.

Preferably, the film 20 is preformed into the required shape, for example by vacuum moulding, and consists of 0.001 ins. "Mylar" (Registered Trade Mark) or other suitable plastics film.

In order to prevent rumble induced by varying electrostatic charges on the record surface, the plates 12 are screened by a screen 22 lying externally of the film 20. The screen 20 is formed from beryllium copper alloy or other suitable material and is preferably not more than 0.003 ins. in thickness. The screen 22 is preformed to the required shape and is preferably secured to the underside of the body 2 by means of a conductive epoxy adhesive, the body 2 itself being conductive and comprising for example a drawn aluminum alloy shell or an ABS moulding plated on its outer surface. Preferably, the portion of the screen 22 facing the arm 10 is tapered in a direction towards the front edge of the screen 22 whereby to increase the gap between the arm 10 and the screen 22 and the front edge portion of the screen 22 is formed with a depressed portion 22*a* which faces the arm 10. Copper leads 24 extend from the plates 12 through apertures 26 in the underside of the body 2 and are connected with suitable circuit elements located within the body 2. The nature of these circuit elements will be readily apparent to those skilled in the art and will not be described further since they form no part of the present invention.

As an alternative to using an electrostatic transduction system, a photoelectric or other non-contact type transducer can be used. In a further alternative arrangement transduction can be effected using a piezoelectric high polymer film, for example polyvinylidene fluoride film which contacts the arm.

The wire compliance 8 between the strip 6 and the block 16 can be encased in a suitable damping compound carried by an extension of the film 20.

In use, the arm 10 is inclined by an angle of 20° to the surface of the record. The forward end portion 10' of the arm 10 carries a stylus tip comprising a diamond 28 of very low mass (for example between $4 \times 10^{-6}$ and $10 \times 10^{-6}$ gm total mass including fixing means) and is inclined to the remainder of the arm 10 such that the forward end portion 10' of the arm extends horizontally. The axis of the arm 10 extends through the tip of the diamond 28 in order to provide the lowest possible polar moment of inertia of the stylus; the alignment of the wire 8 with the axis of the arm 10 also assists in this respect.

In the arrangement described above in which the stylus arm 10 has a compliance wire 8 and transduction is effected ahead of the wire by a non-contact transducer means, by a suitable choice of materials for the wire and the stylus arm, and by suitably dimensioning these parts, the various resonant frequencies of the system can be arranged above the highest recorded frequency (about 20kHz) and the cartridge can track at very low tracking weights, for example less than 0.5 gm. More particularly, the wire 8 is formed from a material having a high yield point and a high Young's Modulus, for example high tensile steel wire or high grade tungsten wire. The stylus arm 10 should have a high stiffness and is preferably formed from beryllium wire or other material having a high rigidity, for example high modulus carbon fibre composites; as an alternative to using inherently rigid materials, materials such as aluminum can be used to form the stylus arm, the arm then being tubular in order to provide the necessary stiffness.

Preferably, in order to attach the wire 8 to the stylus arm 10, the front end portion of the wire 8 is flattened and is inserted into an axial hole drilled in rear end portion of the arm 10. The rear end portion of the arm 10 is then swaged to anchor the wire 8 within the drilled hole.

Alternatively the wire 8 can be attached to the arm 10 by using welding or soldering, particularly capacitor discharge welding or soft soldering if the arm 10 is composed of beryllium wire. In the case of a welded or soldered connection, the front end portion of the wire 8 is secured to the underside of the arm 10, the front end portion of the wire 8 being offset so that the major portion of the wire 8 is aligned with the axis of the arm 10.

In order to attach the wire 8 to the strip 6, a longitudinal slot is formed in the lower surface of the strip 6; the rear end portion of the wire 8 is inserted into the slot and the strip 6 is then swaged to close the slot around the wire 8 and thereby anchor the wire 8.

Since the various resonances of the system can be placed above the highest recorded frequency, the capacitor plates 12 can be inclined by less than 90° included, for example the plates 12 can be inclined by about 75° included, in order to cancel out cross-talk resulting from coupling between the capacitor plates.

The various criteria which determine the size and other parameters of the wire compliance 8 and the stylus arm 10 will now be described in greater detail.

Assuming a rigid stylus arm 10, it can be shown that for constant stylus arm length (L), and stylus tip compliance, the moment of inertia of the wire 8 varies approximately as the length (l) of the wire 8 (for $l \ll$ ).

The end portion of the wire 8 is rigidly attached to the end of the stylus arm 10. Depending on conditions, a proportion of the mass moment of inertia of the stylus arm acts at the junction. Because of the method of attachment, the wire 8 does not behave as a simple cantilever; when the rear end of the stylus arm 10 is deflected the wire 8 will in fact be "contraflexed" in the form of a letter S, which means that its stiffness will be 4 × greater than that of a cantilever of the same dimension.

The vibrating system is assumed to consist of a rigid straight stylus arm of length L and uniform mass per unit length, supported on two springs having compliances of $C_h$ and $C_r$ wherein $C_h$ is the compliance of the wire 8 and $C_r$ the tip-record compliance (resulting from resilient contact between the stylus point and the record material).

This arrangement is an example of the well-known case of a vibrating system consisting of two springs supporting a beam. In this case, the mass is considered to be uniformly distributed along the beam, so that the centre of gravity lies at its centre. The compliances of the two springs however may differ.

The solution of the well known differential equation of this vibrating system yields a two-valued frequency equation. As discussed before all resonances of the system should be above the highest recorded frequency so that the lower of the two frequencies given by the differential equation has to meet this criterion.

To obtain the highest possible resonant frequencies, the stylus arm mass must be reduced as far as possible. This can be achieved by (1) having a relatively short stylus arm, the minimum length being determined by the minimum safe cartridge body — record surface clearance, and (2) by selecting the material and configuration used for the stylus arm.

The value of $C_r$, the tip-record compliance, depends on the tracking force, the Young's modulus of the record material, and the effective tip radius of the diamond. The effective tip radius can be modified without affecting tracking by increasing the major axis of an elliptical diamond thus resulting in a reduction of $C_r$.

The dimensions of the wire 8 can also be adjusted. If the length of the wire 8 is reduced, while at the same time its diameter is adjusted to maintain constant stylus arm compliance, the compliance of a wire 8 of length ($l$) will vary as $l^2$ to a first order for a given stylus arm length (L).

Thus the shorter the wire 8 the higher the natural frequencies of the system. The extent by which ($l$) can be reduced will be dictated by the maximum allowable outer fibre stress in the wire at maximum deflection. Hence to obtain the highest possible frequency, requires the use of a spring wire material with the highest possible yield point and Young's modulus.

In addition to the resonances outlined above, the system will also vibrate in the torsional mode. In order to achieve the highest possible torsional resonant frequency, the polar moment of inertia of the stylus arm has to be kept as low as possible. For this purpose, as discussed before at least a major portion, and preferably the whole of, the wire 8 is arranged to lie on the axis of the stylus arm. Thus at least a major portion of the stylus arm oscillates about its longitudinal axis. The use of a very small diamond also acts to reduce the polar moment of inertia of the arm.

A further advantage stemming from the reduction of the length of the wire 8 discussed above, is that resistive forces resulting from damping applied to the wire 8 are transformed down in the ratio $l^2/(L \times l)^2$, as considered at the stylus tip. Thus even if critical damping is applied to the wire 8, the maximum resistive forces at the stylus tip are negligible (a few % of required tracking force). It is desirable to apply an adequate amount of damping to the system, to suppress unwanted resonances (even if these are above the highest recorded frequency).

The cartridge particularly described thus contrasts with previously prepared cartridges, in which many of the resonances discussed above are in the middle of the recorded frequency range due to very high stylus "back end" mass caused by magnets and the like which are used to effect transduction and to a low $l^2/(L \times l)^2$ ratio. Thus when sufficient and adequate damping is applied, a heavy penalty is paid in the form of very large resistive forces at the stylus tip in the mid audio frequency range.

The specification of three examples of the cartridge is given in Table I, and the approximate resonant frequencies of these cartridges is given in Table II.

As will be apparent, whilst the performance of the cartridge designated as cartridge C in Tables I and II is below that of cartridges A and B, its performance is nevertheless sufficient and the cost of this cartridge will be less than that of cartridges A and B. In general, a cartridge having a stylus assembly constructed as described above with a stylus arm length (L) of less than about $6 \times 10^{-1}$cm, and a high tensile spring wire of a length ($l$) of less than about $7 \times 10^{-2}$cm, with the ratio $L/l$ being between about 8 and 11 should provide adequate results providing the other parameters of these components are selected accordingly. Particularly good results can be obtained when the stylus arm has a length (L) of between $2.0 \times 10^{-1}$cm and $3.0 \times 10^{-1}$cm and the wire has a length ($l$) of between about $2.0 \times 10^{-2}$cm and $3.0 \times 10^{-2}$cm, with the ratio $L/l$ being about 10. When the stylus arm 10 is formed from beryllium, particularly good results can be obtained by using beryllium wire having a diameter of between $1.5 \times 10^{-2}$cm and $3.0 \times 10^{-2}$cm, preferably $2.5 \times 10^{-2}$cm or less.

As will be apparent, the stylus tip comprising the diamond 28 is very small and difficulties may arise in attaching the tip to the stylus arm. A preferred method of attaching the tip to the stylus arm will now be described with reference to FIGS. 6*a* to 6*g*.

Figure 6:
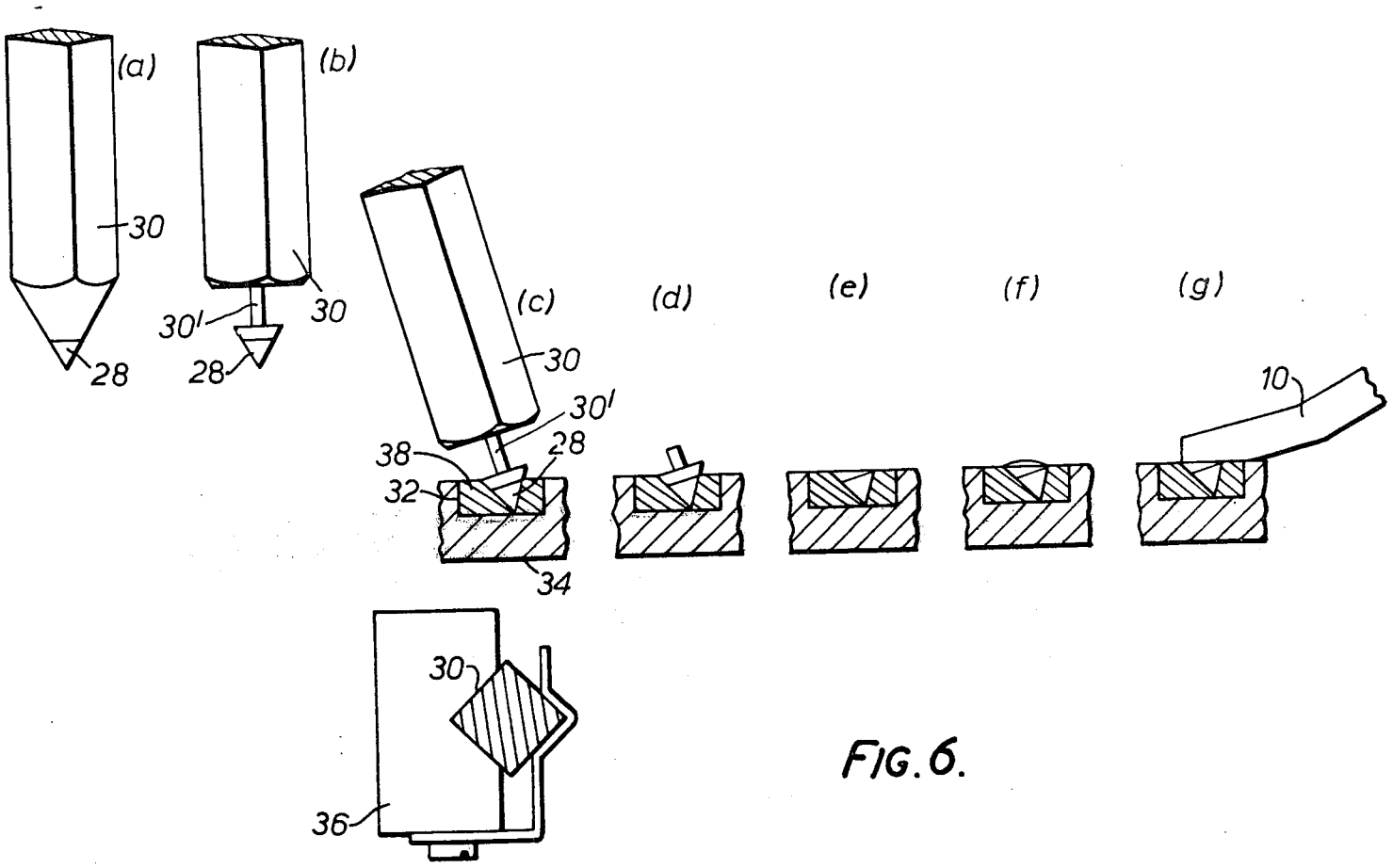
FIGS. 6*a* to 6*g* illustrate successive stages in a process for attaching a stylus tip to a stylus arm.

A diamond is located in a recess in the end portion of a metallic rod 30 and is secured therein by suitable brazing material by methods well known in the art. The end portion of the rod 30 together with the diamond 28 is then ground into a conical configuration as shown in FIG. 6*a* whereby to form the stylus tip which is composed of the diamond and an adjacent portion of the rod 30.

TABLE I

Electrostatic Cartridge. Abridged mechanical specification

| Part | "A" Cartridge | "B" Cartridge | "C" Cartridge |
|---|---|---|---|
| Stylus Arm (10) | | | |
| Material | Beryllium Wire | Beryllium Wire | Aluminum alloy tubing |
| Wire | | | |
| Compliance (8) | | | |
| Material | H. Tensile steel | H. Tensile steel | H. Tensile steel |
| Tip | | | |
| Material | Diamond | As "A" | As "A" |
| Form | Elliptical | As "A" | As "A" |

| | Parameter | "A" Cartridge | "B" Cartridge | "C" Cartridge |
|---|---|---|---|---|
| (a) | Stylus Arm (10) | | | |
| | Mass | $1.27 \times 10^{-4}$ | $2.65 \times 10^{-4}$ | $2.55 \times 10^{-4}$ g. |
| | Effective mass at tip | $4.85 \times 10^{-5}$* | $9.5 \times 10^{-5}$* | $9.5 \times 10^{-5}$ g.* |
| | Length | $2.5 \times 10^{-1}$ | $3 \times 10^{-1}$ | $3 \times 10^{-1}$ cm. |
| | Radius | $9.5 \times 10^{-3}$ | $1.25 \times 10^{-2}$ | $2 \times 10^{-2}$ cm.-outer) $1.75 \times 10^{-2}$ cm.-outer) |
| | Density | 1.8 | 1.8 | 1.8 |
| | Young's Modulus | $3 \times 10^{12}$ | $3 \times 10^{12}$ | $7 \times 10^{11}$ hyne cm$^{-2}$. |
| | Moment of Inertia | $6.2 \times 10^{-9}$ | $1.86 \times 10^{-8}$ | $5 \times 10^{-8}$ g.cm$^2$. |
| | Polar Moment of Inertia | $8.9 \times 10^{-9}$ | $2.7 \times 10^{-8}$ | $1.1 \times 10^{-7}$ g.cm$^2$. |
| | Stylus compliance | $5 \times 10^{-5}$ | $2.5 \times 10^{-5}$ | $2.5 \times 10^{-5}$ cm dyne$^{-1}$ |
| | Stylus tip-record compliance | $1.1 \times 10^{-7}$ | $8.6 \times 10^{-8}$ | $8.6 \times 10^{-8}$ cm dyne$^{-1}$ |
| (b) | Wire Compliance (8) | | | |
| | Length | $2.5 \times 10^{-2}$ | $3 \times 10^{-2}$ cm. | As "B" |
| | Diameter | $4.3 \times 10^{-3}$ | $6 \times 10^{-3}$ cm. | " |
| | Moment of Inertia | $1.6 \times 10^{-11}$ | $6.2 \times 10^{-11}$g.cm$^2$. | " |
| | Polar Moment of Inertia | $3.4 \times 10^{-11}$ | $1.3 \times 10^{-10}$g.cm$^2$. | " |
| | Young's Modulus | $2 \times 10^{12}$ | $2 \times 10^{12}$ dyne cm$^{-2}$. | " |
| | Modulus of Rigidity | $8 \times 10^{11}$ | $8 \times 10^{11}$ dyne cm$^{-2}$. | " |
| | Compliance | $4 \times 10^{-8}$ | $2.2 \times 10^{-8}$ cm dyne$^{-1}$. | " |
| (c) | Diamond | | | |
| | Height | $1.5 \times 10^{-2}$ cm. | As "A" | $2 \times 10^{-2}$ cm. |
| | Mass | $6 \times 10^{-6}$ g.** | " | $9 \times 10^{-5}$ g.** |
| | Radius at major axis | $1.75 \times 10^{-3}$ cm. | " | As "A" |
| | Radius at minor axis | $5 \times 10^{-4}$ cm. | " | " |

*Including diamond.
**Including solder

TABLE II

Resonance calculations for Electrostatic Cartridge

| Type of Resonance | "A" Cartridge | "B" Cartridge | "C" Cartridge |
|---|---|---|---|
| Torsional | 56 | 57 | 27.5 kHz |
| Stylus beam | 170 | 140 | 113 kHz |
| Mass coupled spring | 110 | 120 | 115 kHz |
| Tip mass - record compliance | 69 | 56 | 56 kHz |

At this stage, the stylus tip can be ground into elliptical form if desired; for this purpose, the rod 30 is preferably of rectangular section to enable a known orientation to be established between the rod and the elliptical configuration of the diamond.

A portion of the rod 30 immediately adjacent the ground stylus tip is ground to form a reduced diameter shank portion 30' (FIG. 6*b*), which, together with the portion of the rod above the shank portion forms a support element for the tip.

The ground stylus tip is then inserted into a recess 32 in a mould block 34 such that the tip of the diamond 28 is supported by the bottom surface of the recess 32 (FIG. 6*c*). The upper end portion of the rod 30 is held in a suitable jig 36 which is orientated with respect to the block 34 such that the axis of the rod 30 is inclined at predetermined angle with respect to a plane perpendicular to the upper face of the block 34. The rod 30 is seated in the jig 36 such that the elliptical form (if provided) of the tip is arranged in a predetermined orientation with respect to the block 34. The recess 32 is filled with a cement 38 in fluid form which embeds the ground tip. When the cement 38 has solidified, the shank portion 30' of the rod 30 is cut (FIG. 6*d*), the ground tip remaining accurately located within the recess 32 by means of the cement filling 38.

Preferably, the cement 38 is an ultra-high temperature, ultra strong epoxy, such as that manufactured by Ciba-Geigy (U.K.) Limited and sold under the Trade Name "Araldite A.T.I." A pellet of unpolymerised epoxy is located in the recess 32 and is heated to 120°–130° C, at which temperature the pellet melts and the melted epoxy embeds the ground tip. Upon increasing the temperature to 240°–250° C and maintaining this temperature for about 30 minutes, the epoxy will polymerise and solidify around the ground tip.

The part of the shank portion still remaining attached to the tip is removed by grinding, and the upper surface of the tip, which surface is formed by the portion of the rod immediately adjacent the diamond and below the shank portion 30' as clearly shown in FIGS. 6*b* and 6*d*, is then ground level with the upper surface of the block 34 (FIG. 6*e*), the end portion of the underside of the end portion of the stylus arm 10 being provided with a chamfer to receive this ground surface. If the stylus arm is beryllium, the ground metallic surface of the tip can be tinned (FIG. 6*f*) and can be attached to the arm (FIG. 6*g*) using a soft soldering technique. For this purpose the arm 10 is dipped into a brazing alloy at a temperature above about 600° C, the ground metallic surface then being soldered onto the coated beryllium; the brazing alloy can, for example, be a high zinc brazing alloy such as that sold under the Trade Name "Thescal". With the tip thus attached to the stylus arm, the tip can be removed from the cement 38 by dissolving the cement using a suitable solvent, for example tetrahydrofuran in the case of an epoxy cement.

In an alternative arrangement, the tip can be attached to the stylus arm by an epoxy or other suitable adhesive. In this case, instead of using the epoxy cement described to embed the tip, wax or other substances from which the tip can readily be removed, can be used for this purpose. In the case of wax, for example, the tip can be removed after attachment to the stylus arm by melting the wax.

In the process described above, although the tip is very small, difficulties which would otherwise arise in handling and accurately locating the tip, are obviated. As will be apparent, this process can be used for attaching tips to stylus arms of other forms of cartridge from that shown in FIGS. 1 to 5 or for attaching other small particles to a support member.

What is claimed is:

1. A pick-up cartridge comprising, a body shell, a low mass stylus assembly having a short rigid stylus arm, a stylus tip mounted adjacent a forward end of the stylus arm a substantial part of the length of the stylus arm extending from the rear end thereof being straight and the stylus tip being located in the vicinity of the axis of the straight part of the arm and a resilient wire substantially shorter in length than the stylus arm fixedly attached at its forward end to the stylus arm so as freely to support the stylus arm and having at least a major portion thereof in alignment with the stylus arm, a mounting member provided on the body shell and supporting the rear end of the resilient wire with the stylus assembly inclined forwardly away from the body shell, and transducer means responsive to movement of the stylus arm mounted in the body shell at a location so as to be wholly between the stylus tip and the resilient wire.

2. A cartridge as claimed in claim 1, wherein a forward end part of the stylus arm on which the stylus tip is located is angled with respect to the straight part of the arm to an extent as to position the stylus tip substantially on the axis of the straight part of the stylus arm.

3. A cartridge as claimed in claim 1, wherein the stylus arm is composed of beryllium wire.

4. A cartridge as claimed in claim 1, wherein the transducer means is an electrostatic transducer.

5. A cartridge as claimed in claim 4, wherein the transducer means comprises mutually inclined capacitor plates, the stylus arm extending between the plates in contact free relationship thereto.

6. A cartridge as claimed in claim 5, further comprising a film of non-conductive material, said film being interposed between the plates and the arm, and covering the surface of the plates.

7. A cartridge as claimed in claim 6, further comprising a conductive screen for the plates mounted on the body shell, the stylus arm extending between the plates and the screen.

8. A cartridge as claimed in claim 1, wherein the resilient wire is secured to the rear end of the stylus arm and extends therefrom substantially coaxially with the straight part of the stylus arm.

9. A cartridge as claimed in claim 1, wherein the length (L) of the stylus arm is between $2.0 \times 10^{-1}$cm and $3.0 \times 10^{-1}$cm, and the length ($l$) of the resilient wire is between $2.0 \times 10^{-2}$cm and $3.0 \times 10^{-2}$cm.

10. A cartridge as claimed in claim 9, wherein the stylus arm is formed from beryllium wire having a diameter of between about $1.5 \times 10^{-2}$cm and $3.0 \times 10^{-2}$cm.

11. A cartridge as claimed in claim 1 wherein the resilient wire comprises high tensile steel.

12. A cartridge as claimed in claim 1, wherein the length (L) of the arm is less than $6 \times 10^{-1}$cm and the effective length ($l$) of the resilient wire is less than $7 \times 10^{-2}$cm, the ratio $L/l$ being in the range 8 to 11.

13. A stylus assembly for a gramophone record pick-up cartridge, comprising a short low mass rigid stylus arm, a stylus tip mounted adjacent a forward end of the stylus arm, a substantial part of the length of the stylus arm extending from the rear end thereof being straight and the stylus tip being located in the vicinity of the axis of the straight part of the arm, a resilient wire substantially shorter in length than the stylus arm and fixedly attached at its forward end to the stylus arm so as freely to support the stylus arm and having at least a major portion thereof in alignment with the stylus arm, and a mounting member for attachment to a pick-up cartridge which supports the rear end of the resilient wire with the stylus arm when in operative position inclined forwardly and downwardly.

* * * * *

UNITED STATES PATENT AND TRADEMARK OFFICE

CERTIFICATE OF CORRECTION

PATENT NO. : 4,001,519

DATED : January 4, 1977

INVENTOR(S) : Alexander R. Rangabe

It is certified that error appears in the above-identified patent and that said Letters Patent are hereby corrected as shown below:

Column 4, line 2, insert --L-- before ")."

Column 4, line 48, delete "arm" and replace it with --tip--.

Column 5, lines 4 and 16, delete "$l^2/(Lxl)^2$" and replace it with --$l^2/(L+l)^2$--.

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*